US009746237B2

(12) United States Patent
Smith et al.

(10) Patent No.: US 9,746,237 B2
(45) Date of Patent: Aug. 29, 2017

(54) HAND DRYER

(71) Applicant: Dyson Technology Limited, Wiltshire (GB)

(72) Inventors: Stephen Farrar Smith, Bristol (GB); Philip Jonathan Stephens, Derby (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 596 days.

(21) Appl. No.: 14/106,193

(22) Filed: Dec. 13, 2013

(65) Prior Publication Data

US 2014/0170959 A1 Jun. 19, 2014

(30) Foreign Application Priority Data

Dec. 13, 2012 (GB) ..... 1222515.7

(51) Int. Cl.

| | |
|---|---|
| ***F26B 19/00*** | (2006.01) |
| ***F26B 21/00*** | (2006.01) |
| ***A47K 10/48*** | (2006.01) |

(52) U.S. Cl.

CPC ..... *F26B 21/004* (2013.01); *A47K 10/48* (2013.01)

(58) Field of Classification Search

CPC ..... F26B 21/004; F26B 21/00; A47K 10/48; A47K 10/00; B05B 1/04; B05B 13/06; A45D 20/12; A45D 20/00; A45D 20/122; F24F 2009/007; F24F 9/00

USPC ..... 34/227, 229, 230, 232, 233, 234, 235; 454/305, 53, 55, 284, 301, 141

See application file for complete search history.

(56) References Cited

U.S. PATENT DOCUMENTS

2009/0034946 A1* 2/2009 Caine ..... A47K 10/48 392/380

FOREIGN PATENT DOCUMENTS

| | | |
|---|---|---|
| DE | 20 2005 018 472 | 2/2006 |
| EP | 2 554 085 | 2/2013 |
| GB | 2 428 570 | 2/2007 |
| GB | 2 428 571 | 2/2007 |
| JP | 11-244191 | 9/1999 |
| JP | 2002-136448 | 5/2002 |
| JP | 2005-168799 | 6/2005 |
| JP | 3823235 | 7/2006 |

(Continued)

OTHER PUBLICATIONS

International Search Report and Written Opinion mailed Apr. 23, 2014, directed to International Application No. PCT/GB2013/053025; 9 pages.

(Continued)

*Primary Examiner* — Kenneth Rinehart
*Assistant Examiner* — Bao D Nguyen
(74) *Attorney, Agent, or Firm* — Morrison & Foerster LLP

(57) ABSTRACT

A hand dryer comprising a first jetting nozzle comprising a first duct in fluid communication with a first slot which forms a first nozzle outlet and a second jetting nozzle, disposed opposite the first jetting nozzle, comprising a second duct in fluid communication with a second slot which forms a second nozzle outlet. The first and second slots extend transversely with respect to the hand dryer. At least a portion of each of the first and second slots is curved such that the distance between the slots varies in the longitudinal direction of at least one of the slots. The hand dryer further comprises a blower which blows air through the jetting nozzles to produce respective air jets.

4 Claims, 9 Drawing Sheets

(56) References Cited

FOREIGN PATENT DOCUMENTS

| | | |
|---|---|---|
| JP | 2009-502392 | 1/2009 |
| WO | WO-2007/015036 | 2/2007 |
| WO | WO-2012/017570 | 2/2012 |
| WO | WO 2012017570 A1 * | 2/2012 |

OTHER PUBLICATIONS

Search Report dated Apr. 8, 2013, directed to GB Application No. 1222515.7; 1 page.

* cited by examiner

HAND DRYER

REFERENCE TO RELATED APPLICATIONS

This application claims the priority of United Kingdom Application No. 1222515.7, filed Dec. 13, 2012, the entire contents of which are incorporated herein by reference.

FIELD OF THE INVENTION

This invention relates to a hand dryer.

BACKGROUND OF THE INVENTION

GB 2428 570 discloses a hand dryer which comprises opposing jetting nozzles between which a user places his/her hands for drying.

In use, a relatively high-velocity jet of air is emitted from each nozzle. The nozzles are arranged such that the jets of air are inclined with respect to each other and intersect each other between the nozzles. The user inserts his/her hands between the nozzles so that the jets impact on opposite sides of the hands. The jets of air dry the user's hands by blowing water from the surface of each hand.

It is known that the collision of the jets contributes to the noise produced by the hand dryer during use. The amount of noise generated can be reduced by reducing the velocity of the jets. However, any reduction in the velocity of the jets produces a corresponding decrease in the time it takes for the hand dryer to dry hands (overall drying time), which is undesirable.

WO2012017570 discloses a hand dryer comprising a nozzle having a wavy slot. The wavy slot reduces the noise produced by the hand dryer. However, the wavy slot is difficult to manufacture and not compact.

SUMMARY OF THE INVENTION

The present invention particularly relates to a hand dryer comprising a jetting nozzle comprising a duct in fluid communication with a slot which forms a nozzle outlet, and a blower which blows air through the jetting nozzle to produce an air jet.

According to a first aspect of the invention there is provide a hand dryer comprising a first jetting nozzle comprising a first duct in fluid communication with a first slot which forms a first nozzle outlet; a second jetting nozzle disposed opposite the first jetting nozzle, comprising a second duct in fluid communication with a second slot which forms a second nozzle outlet, and a blower which blows air through the jetting nozzles to produce respective air jets, wherein the first and second slots extend transversely with respect to the hand dryer and at least a portion of each of the first and second slots is curved such that the distance between the slots varies in the longitudinal direction of at least one of the slots.

A portion of each of the first and second slots may be concave.

One or each of the first and second slots may comprise a first scalloped section and a second scalloped section, the first and second scalloped sections of the slot, or each of the slots, being disposed adjacent each other with respect to the longitudinal direction of the, or the respective, slot. The respective first scalloped sections may oppose each other and the respective second scalloped sections may oppose each other.

The curvature of each of the first and second slots may correspond to the profile of adjacent hands placed between the slots with each hand open and the palms of each hand facing the same one of the slots. For example, the curvature of the first and second slots may correspond to the profile of a pair of hands, held outwardly with thumbs together, across the region of knuckles.

The nozzles may be configured such that air exits each of the first and second slots in a direction which is substantially perpendicular to the plane of the respective slot, thereby focussing each jet towards the center of respective regions defined by the opposing first scalloped sections and the opposing second scalloped portions.

The first and second jetting nozzles may be arranged such that the air jets intersect each other.

According to a second aspect of the present invention there is provided a hand dryer comprising: a jetting nozzle comprising a duct in fluid communication with a slot which forms a nozzle outlet, the duct comprising opposing first and second surfaces which extend along opposite sides of the slot, and a blower which blows air through the jetting nozzle to produce an air jet, wherein the angle of inclination of the first surface of the duct with respect to a direction which is perpendicular to the longitudinal direction of the slot varies in the longitudinal direction of the slot.

The slot may be substantially straight. However, edges and/or surfaces of the nozzle/duct defining the slot may be straight/flat or curved. The slot may extend in a transverse direction with respect to the hand dryer.

The first and second surfaces may be arranged such that the angle of inclination of the air jet as it exits the slot varies in the longitudinal direction of the slot. The angle of inclination of the first surface with respect to the angle of inclination of the second surface may vary in the longitudinal direction of the slot.

The angle of inclination of the first surface may vary substantially sinusoidally in the longitudinal direction of the slot.

The first surface may be an upper surface of the duct.

The angle of inclination of the first surface with respect to the horizontal may be less at a central region of the slot than at regions of the slot each side of the central region.

The first surface may have a convoluted profile having a plurality of convolutions, the convolutions extending away from the slot in a generally upstream direction. The slot may be defined by an edge of the second surface and the first surface.

The slot may have a width which is defined as the distance between the first surface and said edge of the second surface in a direction which is perpendicular to first surface. The width of the slot may be substantially constant along the length of the slot.

The edge of the second surface may be straight. The first surface may extend forward of the slot to form a lip which guides air as it exits the slot.

The profile of the lip portion of the first surface may have a profile which corresponds with the profile of the portion of the first surface upstream of the duct. For example, the angle of inclination of the lip portion may be the same as the angle of inclination of the first surface. The duct may converge in the direction of the slot (i.e. towards the slot).

According to a third aspect of the invention there is provided a hand dryer comprising a jetting nozzle comprising a duct in fluid communication with a slot which forms a nozzle outlet, and a blower which blows air through the jetting nozzle to produce an air jet, wherein the jetting nozzle is configured such that the angle of inclination of the air jet with respect to a direction which is perpendicular to the longitudinal direction of the slot varies in the longitudinal direction of the slot.

The angle of inclination of the air jet with respect to the horizontal may be less at a central region of the slot than at regions of the slot each side of the central region.

The slot may be provided with a lip which extends forward of the slot, wherein the lip is arranged to guide the air as it exits the slot such that the angle of inclination of the air jet with respect to the direction which is perpendicular to the longitudinal direction of the slot varies in the longitudinal direction of the slot.

The jetting nozzle may be configured such that the angle of inclination of the air jet may vary substantially sinusoidally in the longitudinal direction of the jet. For example, the angle of inclination of the air jet may increase from one end of the slot towards a first intermediate region of the slot, defined between said end of the slot and the center of the slot; decrease from the first intermediate region toward the centre of the slot; increase from the center of the slot towards a second intermediate region of the slot, defined between the center of the slot and the other end of the slot, and decrease from the second intermediate region towards the other end of the slot.

The jetting nozzle may be a first jetting nozzle and the hand dryer may further comprise a second jetting nozzle which opposes the first jetting nozzle, the second jetting nozzle comprising a second duct in fluid communication with a second slot which forms a second nozzle outlet.

The jetting nozzles may be arranged such that each nozzle generates a jet of air which intersects the jet of air generated by the other nozzle.

The nozzles may be arranged such that the variation in the angle of inclination of the air jet generated by the first jetting nozzle varies the height of the intersection of the jets in the longitudinal direction of said slot.

The nozzles may be arranged such that the distance between the intersection of the jets, for example the projected intersection of axes of the jets, and at least one of the slots varies in the longitudinal direction of said slot.

The jetting nozzles may be arranged such that at least one of the nozzles directs air in a downward direction. The jetting nozzles may be arranged such that both nozzles direct air in a downward direction.

The nozzles may be arranged such that the distance between the respective slots varies in the longitudinal direction of said slot. The distance between the slots may be less at a central region of said slot than at the regions of said slot each side of the central region of said slot.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
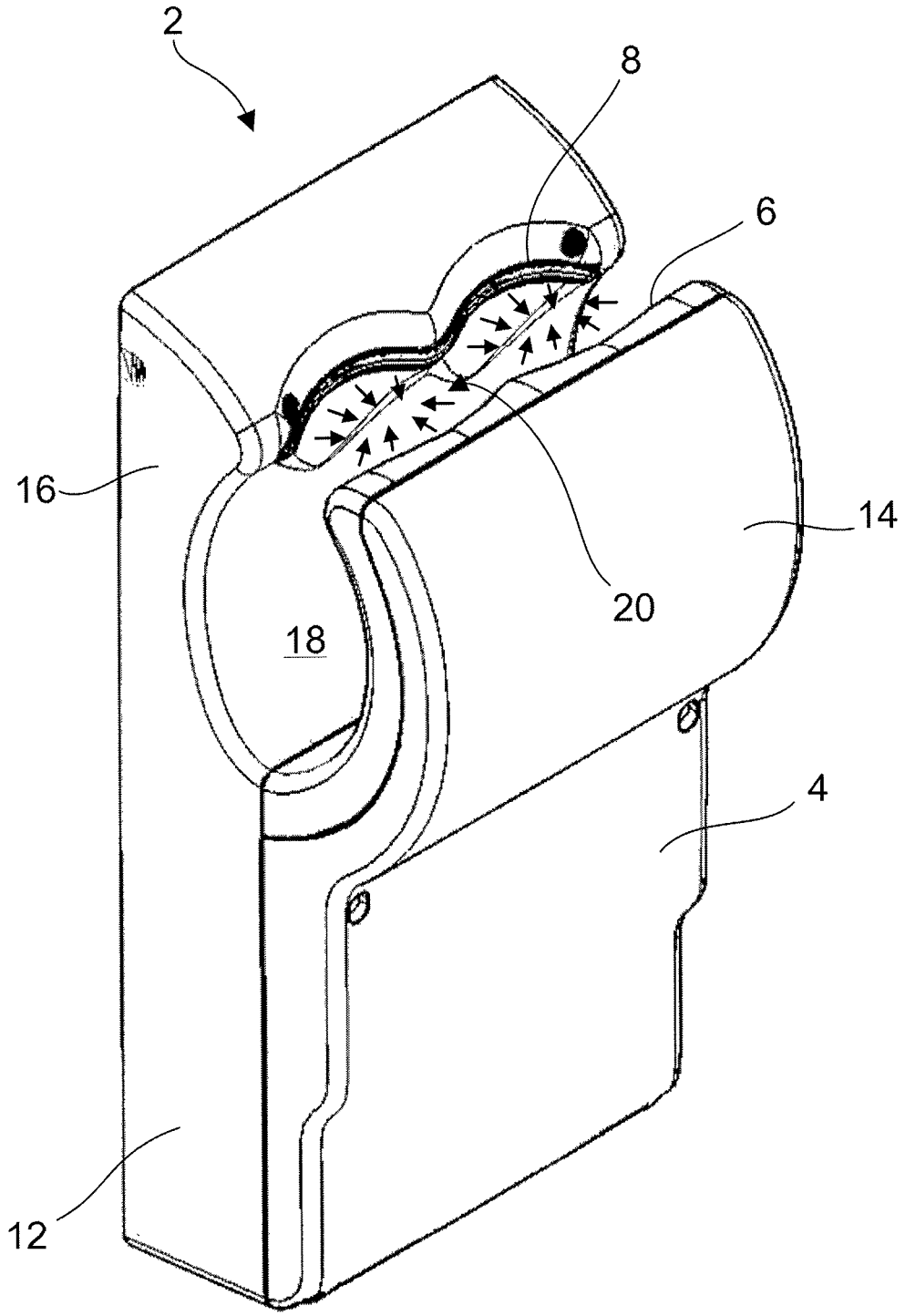
FIG. 1 is a perspective view of a hand dryer.
Figure 2:
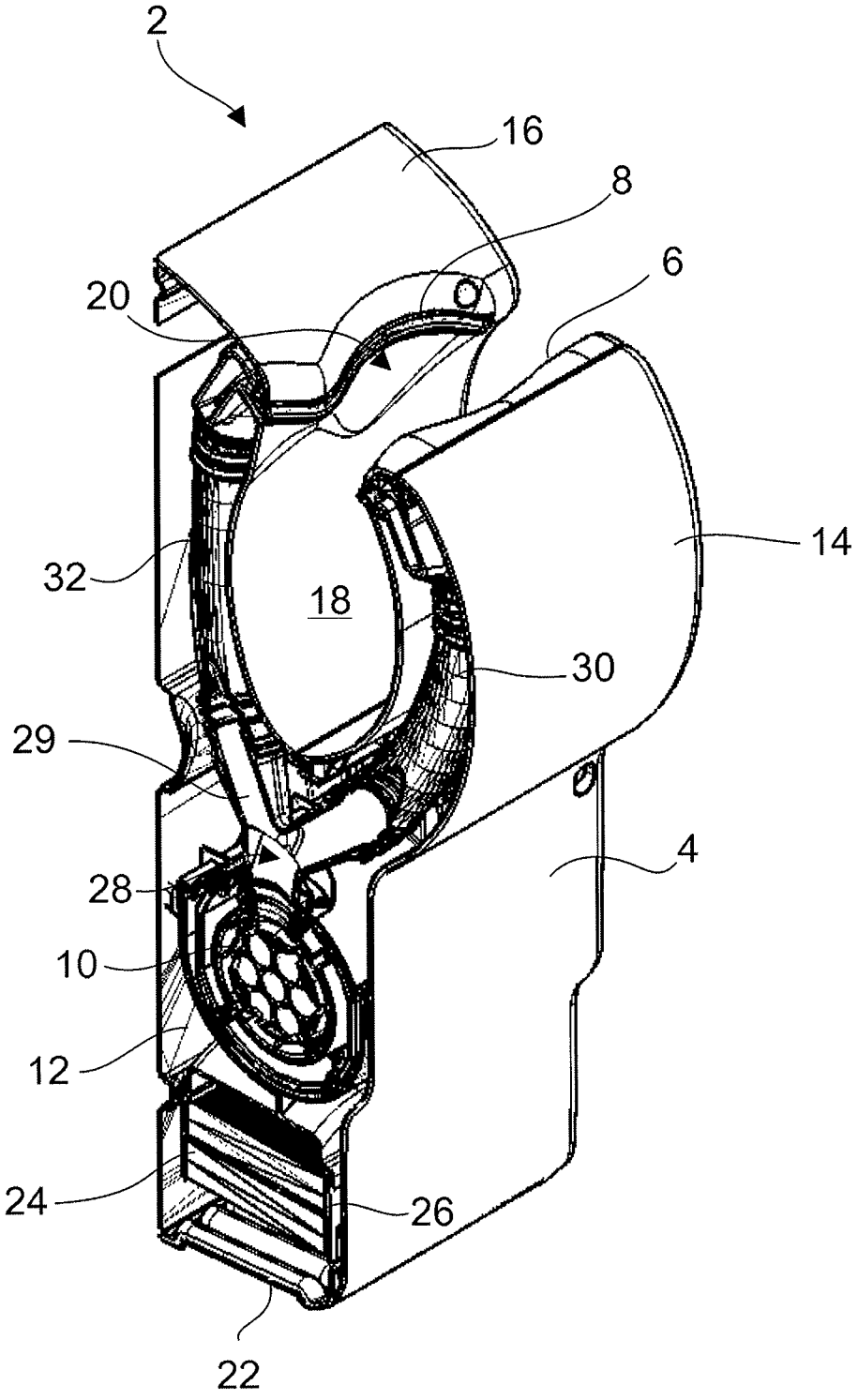
FIG. 2 is a cut-away perspective view of the hand dryer shown in FIG. 1.

FIGS. 1 and 2 show a wall-mounted hand dryer 2 comprising a housing 4, first and second jetting nozzles 6, 8 and a blower 10, in the form of a motor-driven compressor, arranged to blow air through the nozzles 6, 8. The hand dryer 2 is shown upright and has a transverse direction which is perpendicular to the upright (i.e. vertical) direction.

The housing 4 comprises a lower portion 12, a front arm 14 and a rear arm 16. The front and rear arms 14, 16 extend upwardly from the lower portion 12. The arms 14, 16 define a drying cavity 18 between them having an elongate opening 20 at the top of the drying cavity 18. Hands can be inserted through the elongate opening 20 into the drying cavity 18.

The first and second jetting nozzles 6, 8 are disposed on opposite sides of the elongate opening 20 and are housed by the respective front and rear arms 14, 16.

The blower 10 is housed by the lower portion 12 of the housing 4. An intake port 22 is provided through the bottom of the housing 4. An intake duct 24 extends between the intake port 22 and the blower 10 and provides fluid communication between the intake port 22 and the blower 10. A pre-blower filter 26 is disposed in the intake duct 24 and is arranged to filter air drawn into the blower 10 through the intake port 22.

A connecting duct 28 extends between the blower 10 and the first and second jetting nozzles 6, 8. The connecting duct 28 comprises a splitter 29 connected to a first tube 30 and a second tube 32. The first tube 30 extends upwardly within the first arm 14 to the first jetting nozzle 6. The second tube 32 extends upwardly within the second arm 16 to the second jetting nozzle 8.

Figure 3:
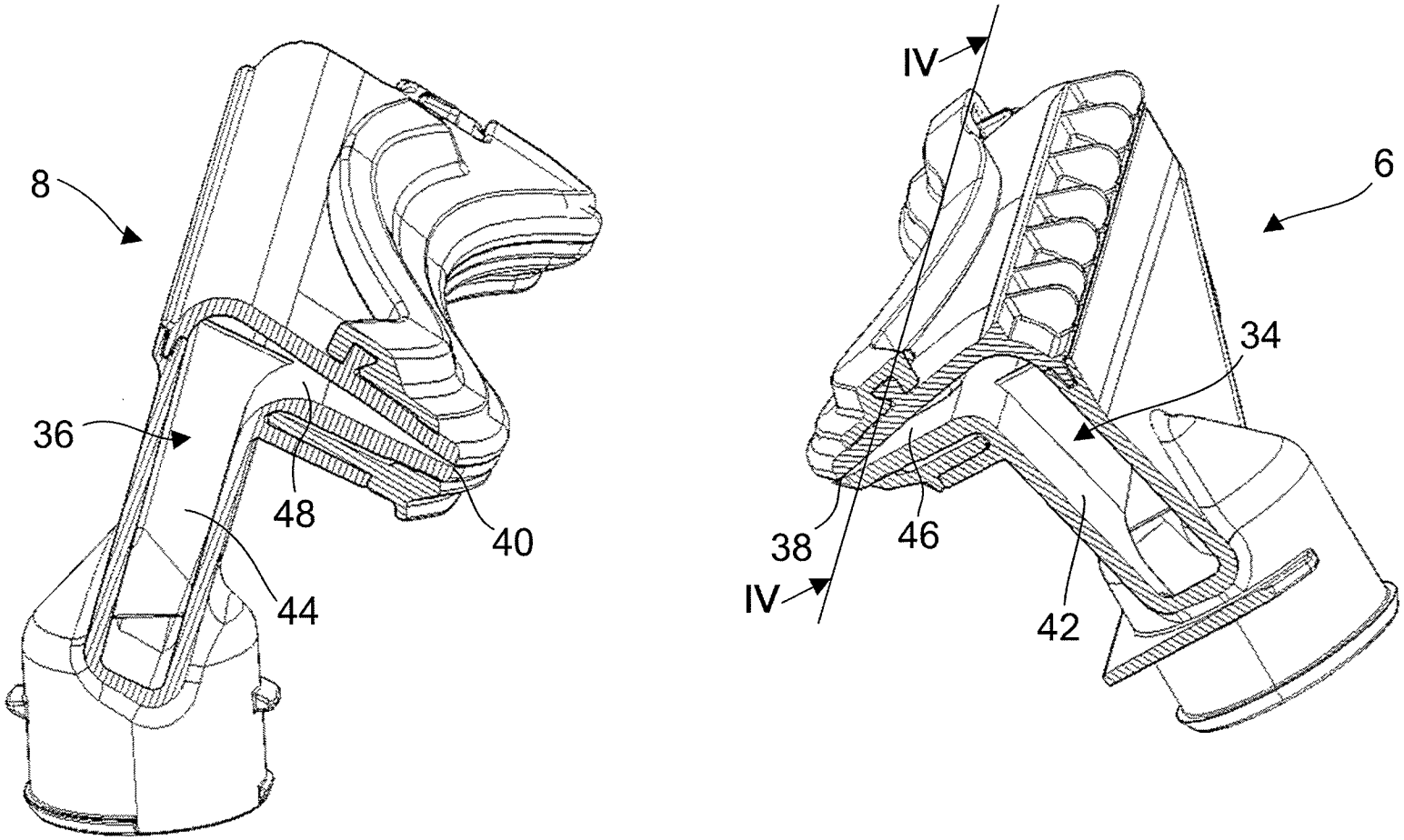
FIG. 3 is a cut-away perspective view of nozzles of the hand dryer shown in FIG. 1.

FIG. 3 shows the jetting nozzles 6, 8 in isolation. The nozzles 6, 8 comprise respective first and second ducts 34, 36 which are in communication with respective first and second slots 38, 40. The slots 38, 40 are straight slots which provide nozzle outlets. Each duct 34, 36 comprises an expansion section 42, 44 and a jetting section 46, 48.

Each expansion section 42, 44 is a divergent duct section which provides fluid communication between a respective one of the tubes 30, 32 and the jetting section 46, 48 of each nozzle 6, 8. Each jetting section 46, 48 extends from the expansion section 42, 44 of each nozzle 6, 8 and is inclined with respect to the expansion section 42, 44. Each jetting section 46, 48 extends downwardly with respect to the upright direction of the hand dryer 2.

Figure 8:
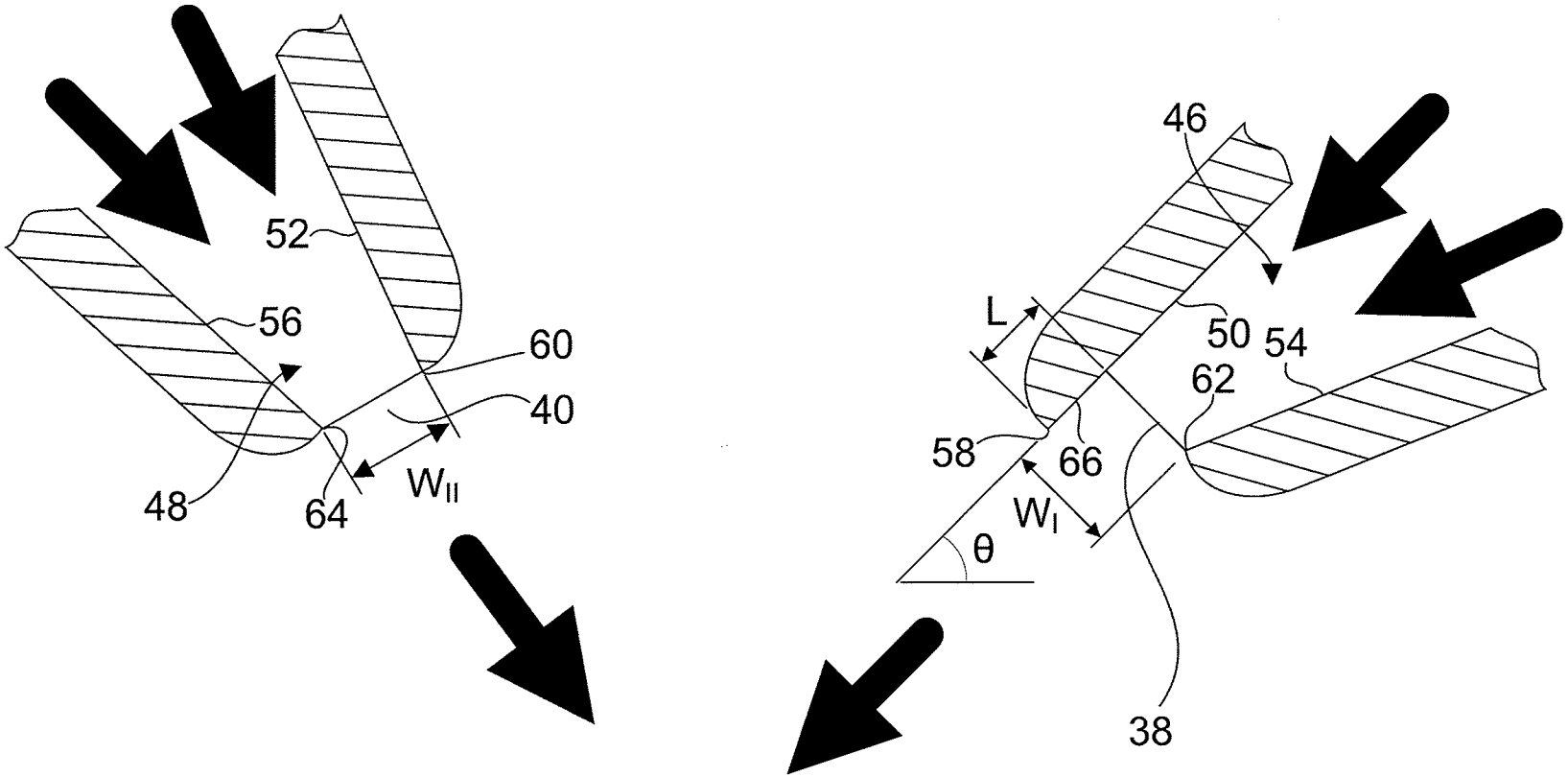
FIG. 8 is a schematic representation of flow through parts of the nozzles shown in FIG. 3.

As shown in FIG. 8, each jetting section 46, 48 comprises an upper surface 50, 52 and a lower surface 54, 56. The respective upper and lower surfaces 50, 52, 54, 56 define opposing walls of each jetting section 46, 48.

The upper surface 50, 52 of each jetting section 46, 48 extends in a downward direction and has an edge which forms an upper edge 58, 60 of the jetting section 46, 48. The lower surface 54, 56 of each jetting section 46, 48 also extends in a downward direction and has a corresponding edge which forms a lower edge 62, 64 of each jetting section 46, 48.

The respective upper and lower surfaces 50, 52, 54, 56 of each jetting section 46, 48 converge in the direction away from the expansion section 42, 44. The upper and lower surfaces 50, 52, 54, 56 are spaced apart by spacers 65 (shown in FIG. 4) arranged at intervals along the length of each slot 38, 40.

The first slot 38 corresponds to the throat of the jetting section 46 of the first nozzle 6, which is the narrowest portion of the jetting section 46. The first slot 38 extends transversely with respect to the jetting section 46. In the embodiment shown, the first slot 38 is defined between the upper surface 50 of the jetting section 46 and the lower edge 62 of the jetting section 46. The width $W_I$ of the first slot 38 is the distance between the upper surface 50 and the lower edge 62 in a direction which is perpendicular to the upper surface 50, as shown in FIG. 8. In the embodiment shown, the width $W_I$ of the first slot 38 is not greater than 1 mm. In addition, the width $W_I$ of the first slot 38 varies along the length of the slot 38. For example, the width of the slot 38 may vary between 0.3 mm at the ends of the slot 38 and 0.4 mm at the center of the slot 38. The plane of the first slot 38 extends along the length of the lower edge 62 and in a direction which is perpendicular to the upper surface 50.

The upper surface 50 comprises a lip portion 66 which extends forward of the first slot 38. The lip portion 66 extends a predetermined distance L away from the first slot 38. In the embodiment shown, the lip portion 66 extends 1.25 mm away from the first slot 38. In the embodiment shown, the lip portion 66 is coplanar with the portion of the upper surface 50 upstream of the slot 38. However, it will be appreciated that the lip portion 66 may be angled to the portion of the upper surface 50 upstream of the first slot 38 and/or curved to direct air exiting the first slot 38 in a desired direction.

Figure 9:
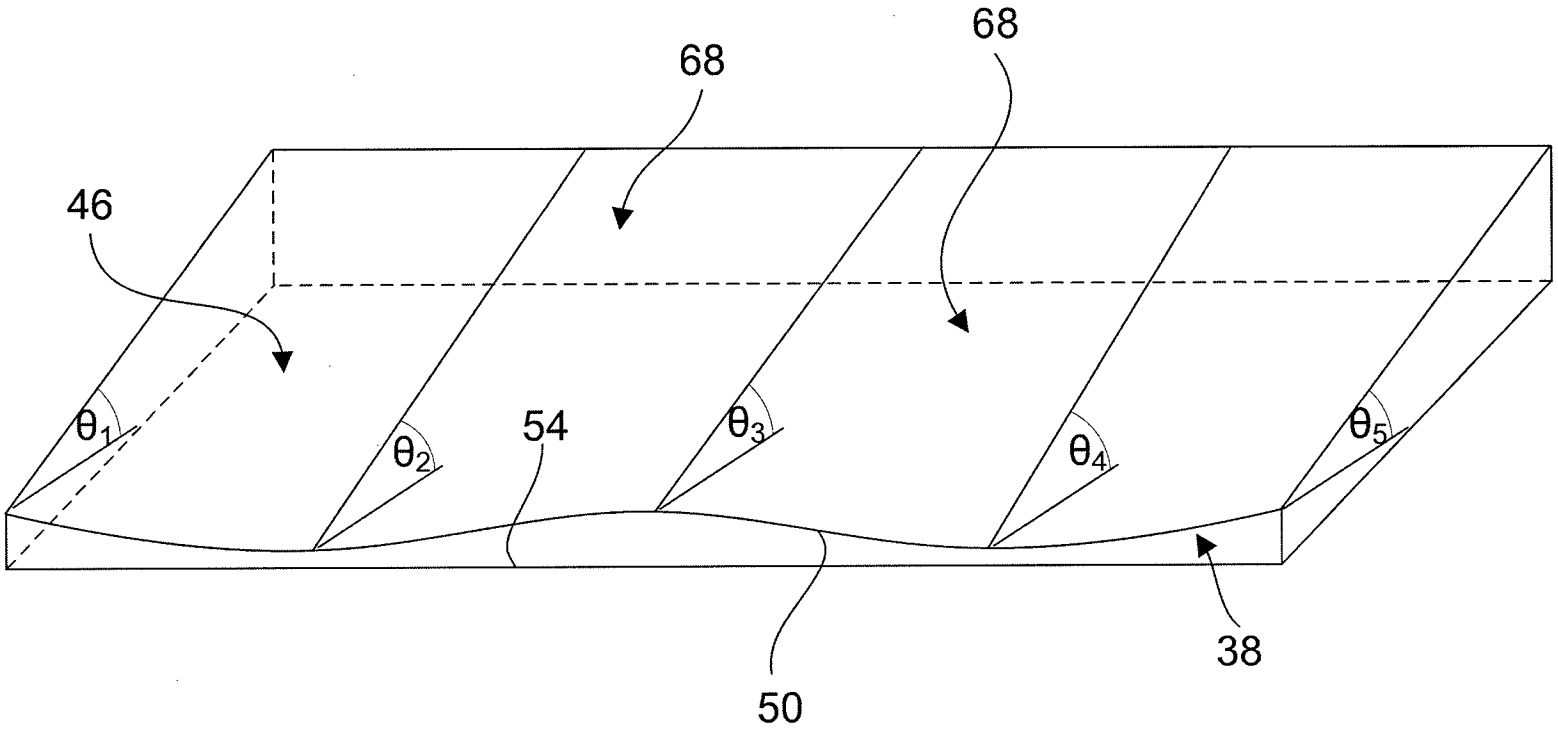
FIG. 9 is a schematic representation of part of the nozzle shown in FIG. 4.

The upper surface 50 of the jetting section 46 is inclined with respect to the horizontal. As shown in FIG. 9, the angle of inclination θ of the upper surface 50 with respect to the horizontal varies in the longitudinal direction of the first slot 38. In particular, the angle of inclination θ of the upper surface 50 varies substantially sinusoidally in the longitudinal direction of the slot 38 between an angle of not less than 0 degrees and not more than 75 degrees with respect to the horizontal direction. In the embodiment shown, the angle of inclination θ varies sinusoidally from 51 degrees ($\theta_1$) at one end of the first slot 38 through 59 degrees ($\theta_2$) at a first intermediate region of the first slot 38, which is located between said end of the first slot 38 and the center of the first slot 38, to 50 degrees ($\theta_3$) at the center of the first slot 38. The angle of inclination θ varies similarly from the center of the first slot 38 through a second intermediate region of the first slot 38, at which the angle of inclination is 59 degrees ($\theta_4$), to the opposite end of the first slot 38, at which the angle of inclination is 51 degrees ($\theta_5$).

Figure 4:
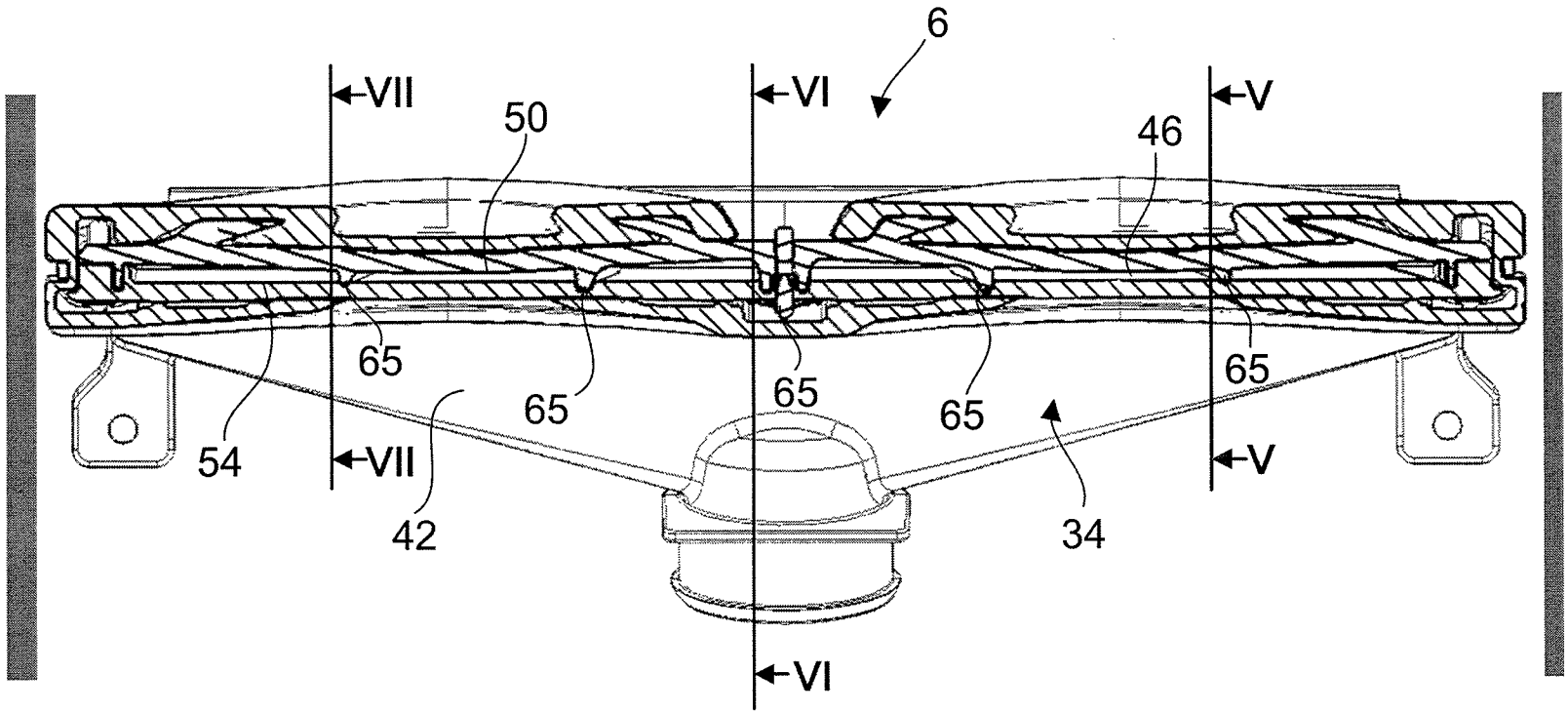
FIG. 4 is a sectional view of one of the nozzles shown in FIG. 3 along line IV-IV.
Figure 5:
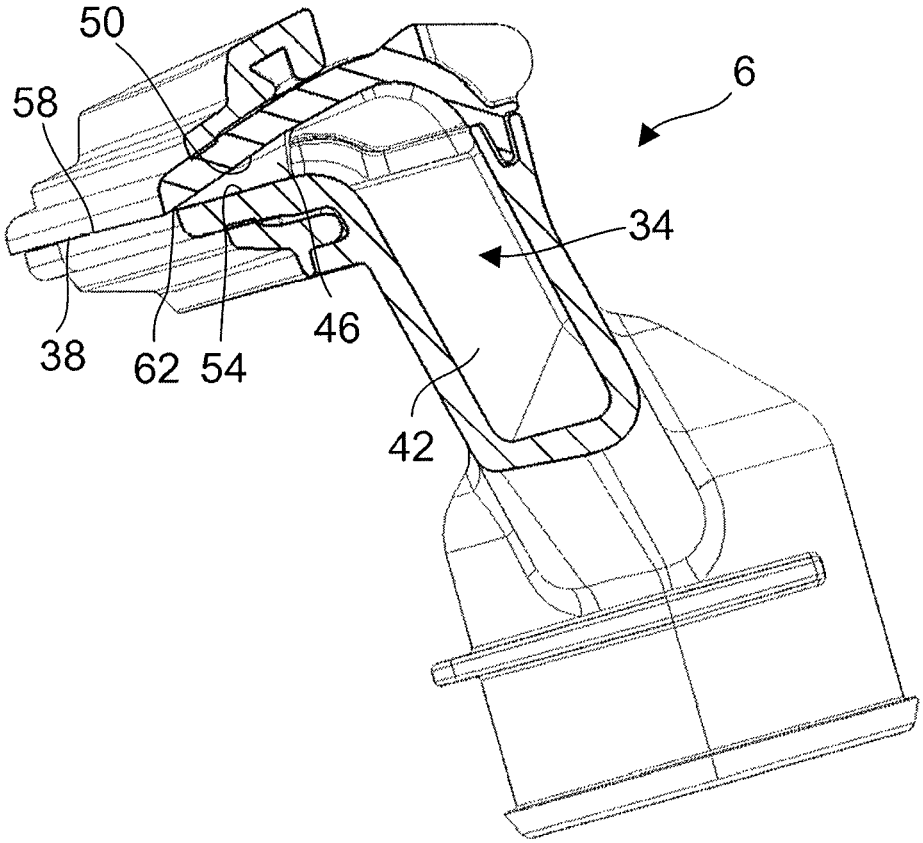
FIG. 5 is a sectional view of the nozzle shown in FIG. 4 along line V-V.
Figure 6:
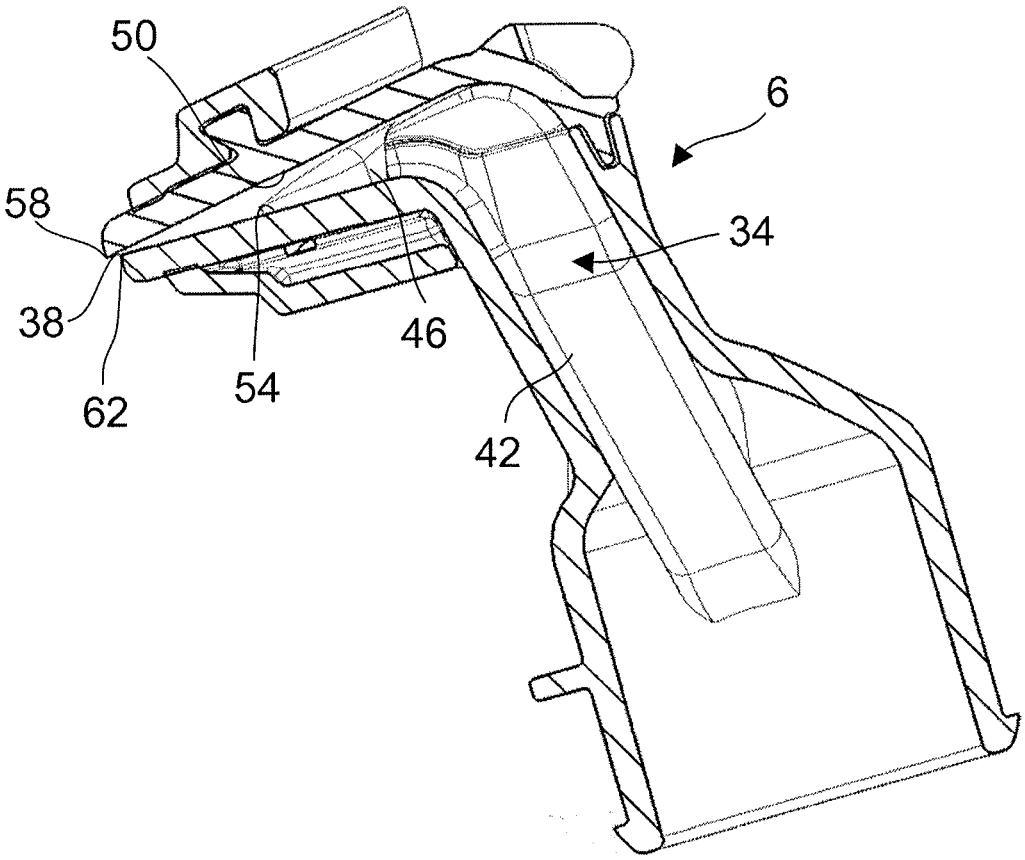
FIG. 6 is a sectional view of the nozzle shown in FIG. 4 along line VI-VI.
Figure 7:
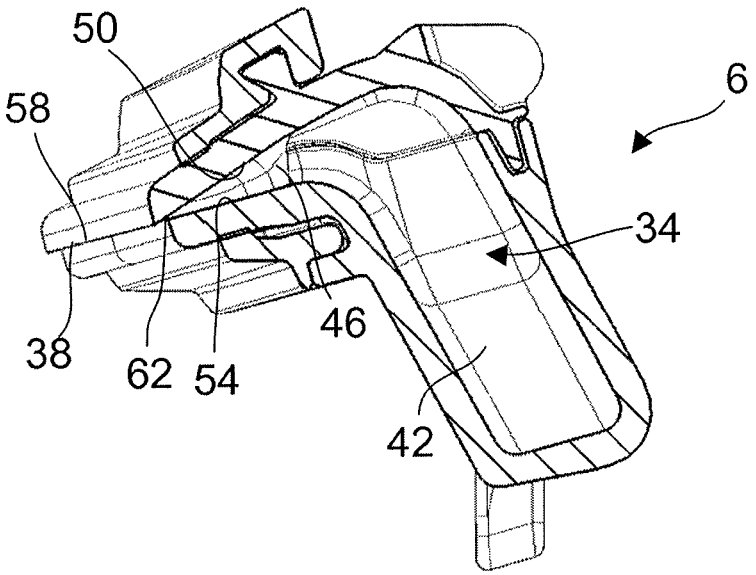
FIG. 7 is a sectional view of the nozzle shown in FIG. 4 along line VII-VII.

The change in the profile of the upper surface 50 as a consequence of the variation in the angle of the upper surface 50 is also illustrated by FIGS. 4 to 7. FIG. 4 is a front sectional view through the first jetting nozzle 6 in a plane upstream of the first slot 38. FIGS. 5 to 7 are sectional views through the first jetting nozzle 6 along lines V-V, VI-VI and VII-VII.

The upper surface 50 forms a convoluted surface with raised convolutions 68, shown in FIG. 9, extending on each side of the center of the slot 38 from the upper edge 58 in the upstream direction of the jetting section 46. The height of each convolution 68 decreases from the upper edge 58 towards the rear of the first jetting section 46.

The angle of inclination of the lower surface 54 of the jetting section 46 is substantially constant in the longitudinal direction of the first slot 38 (i.e. the lower surface 54 is flat). In the embodiment shown, the angle of inclination of the lower surface is 40 degrees. However, it may be between 25 and 50 degrees.

With reference to FIG. 8, the second slot 40 corresponds to the throat of the jetting section 48 of the second nozzle 8, which is the narrowest portion of the jetting section 48. The second slot 40 extends transversely with respect to the jetting section 48.

The second slot 40 is defined between the upper edge 60 and the lower edge 64 of the jetting section 48. The width $W_{II}$ of the second slot 40 is the distance between the upper edge 60 and the lower edge 64. The width of the second slot 40 is not greater than 1 mm. For example, the width of the second slot 40 may vary between 0.3 mm at the ends of the slot 40 and 0.4 mm at the center of the slot 40.

The slot 38, 40 of each jetting nozzle 6, 8 has a scalloped profile, when viewed from above the opening 20 (i.e. the direction in which hands are inserted into the drying cavity 18). In particular, each slot 38, 40 comprises adjacent concave portions. The concave portions form respective scalloped sections of the slot 38, 40. The scalloped sections of the first slot 38 face the respective scalloped sections of the second slot 40 so as to define two substantially oval-shaped regions of the elongate opening 20. The slots 38, 40 are closest at the central region of the elongate opening 20, between the respective scalloped sections.

In the embodiment shown, the angle of inclination θ of the upper surface 50 of the jetting section 46 of the first nozzle 6 varies in accordance with the scalloped profile of the first slot 38 such that the angle of inclination θ is least in the region of the elongate opening 20 at which the slots 38, 40 are closest (i.e. at the central region and the ends of the first slot 38).

In use, air is drawn by the blower 10 through the intake port 22, intake duct 24 and pre-blower filter 26. The air is blown by the blower 10 along the connecting duct 28 and through the nozzles 6, 8. As the air is funnelled through the jetting section 46, 48 of each nozzle 6, 8 it is compressed by the converging upper and lower surfaces 50, 52, 54, 56 and exits each slot 38, 40 as a relatively high-velocity planar jet of air.

The jets of air extend along projected jet axes in the generally downward direction into the drying cavity 18. The projected jet axes intersect each other within the drying cavity below the elongate opening 20. It will be appreciated that the jets will diverge in the direction away from the slots 38, 40 and so produce a region of collision between the jets. The region in which the jets collide is the region of intersection. The region of intersection of the jets extends in a transverse direction with respect to the hand dryer 2.

As shown in FIG. 1, the scalloped profile of the slots 38, 40 directs air exiting the slots 38, 40 towards the center of each of the oval-shaped regions of the elongate opening 20. This focuses (i.e. concentrates) the air flow in the regions of the drying cavity 18 in which hands of a user are inserted, thereby improving drying effectiveness in these regions.

The angle of inclination of the jet generated by the second nozzle 8 is constant along the length of the second slot 40. In contrast, the angle of inclination of the jet generated by the first nozzle 6 varies in the longitudinal direction of the first slot 38. The angle of inclination corresponds to the angle of inclination θ of the upper surface 50 of the first jetting section 46 which directs the air through the first slot 38. The direction of the jet is dependent on the angle of inclination θ of the upper surface 50, particularly the angle of the lip portion 66 which guides the air as it exits the first slot 38.

Because the jet generated by the first nozzle 6 is inclined further downward at the intermediate regions of the first slot 38, the jet projects further downwardly into the drying cavity 18 in the intermediate regions than at the central region or end regions of the first slot 38. Consequently, the jet generated by the first nozzle 6 intersects the jet generated by the second nozzle 8 at a position which is lower in the drying cavity 18 at the intermediate regions than at the central and end regions. The distance of the intersection of the jets is therefore further away from each of the slots 38, 40 at the intermediate regions than at the central and end regions of the slots 38, 40.

As a consequence, interference of the jets at the intermediate regions is less than at the other regions and so less noise is generated. Although drying effectiveness in the intermediate regions is also reduced, the overall drying time does not increase because hands placed in the drying cavity are typically less wet in the intermediate regions than at the central and end regions of the slots 38, 40. The drying time at each region is therefore similar even though the drying effectiveness in some regions is less than in others.

An advantage of the arrangement is that a variation in the profile of the jet produced by the first nozzle 6, and hence a variation in the position of the intersection of the jets, is achieved without having to vary the profile of either of the slots 38, 40 significantly. Both slots 38, 40 can therefore be substantially straight which makes them simpler and relatively inexpensive to design and manufacture.

It will be appreciated that the first slot may have a constant width $W_{II}$ along its length. The second surface of the first slot may also have an angle of inclination which varies in the longitudinal direction of the first slot. It will be appreciated that the angle of inclination of the first and second surfaces of the first slot may be arranged such that the angle of inclination of the air jet exiting the first nozzle is substantially constant along the length of the first slot.

The second nozzle 8 may also comprise a duct having first and second surfaces which extend along opposite sides of the second slot 40, wherein the angle of inclination of at least one of the surfaces varies in the longitudinal direction of the second slot 40. The angle of inclination of said surface of the second nozzle 8 may correspond to the angle of inclination of the inclined surface of the first nozzle 6.

Although the described embodiment shows two opposing jetting nozzles which produce intersecting jets, it will be appreciated that the jetting nozzles could be arranged to produce non-intersecting jets. Furthermore, it will be appreciated that the hand dryer may comprise a single jetting nozzle.

The invention claimed is:

1. A hand dryer comprising:

a first jetting nozzle comprising a first duct in fluid communication with a first slot which forms a first nozzle outlet, a second jetting nozzle disposed opposite the first jetting nozzle, comprising a second duct in fluid communication with a second slot which forms a second nozzle outlet, and a blower which blows air through the jetting nozzles to produce respective air jets, wherein each of the first and second slots extend transversely with respect to the hand dryer and comprise only two adjacent concave portions, the concave portions of the first slot are directly opposite the respective concave portions of the second slot so as to define two oval-shaped regions between the first and second slots, wherein a distance between the slots varies in a longitudinal direction of at least one of the slots.

2. The hand dryer of claim 1, wherein a curvature of each of the first and second slots corresponds to a profile of adjacent hands placed between the slots with each hand open and palms of each hand facing the same one of the slots.

3. The hand dryer of claim 1, wherein the nozzles are configured such that air exits each of the first and second slots in a direction which is perpendicular to a plane of the respective slot, thereby focussing each jet towards a center of respective regions defined by the opposing first concave portions and the opposing second concave portions.

4. The hand dryer of claim 1, wherein the first and second jetting nozzles are arranged such that the air jets intersect each other.

* * * * *